United States Patent [19]

Grabovac et al.

[11] Patent Number: 4,513,645

[45] Date of Patent: Apr. 30, 1985

[54] HYDRAULIC WRENCH

[76] Inventors: Bosko Grabovac; Ivan N. Vuceta, both of P.O. Box 8830, City of Industry, Calif. 91748

[21] Appl. No.: 575,568

[22] Filed: Jan. 31, 1984

Related U.S. Application Data

[63] Continuation-in-part of Ser. No. 337,535, Jan. 7, 1982, abandoned.

[51] Int. Cl.[3] ..... B25B 13/46

[52] U.S. Cl. ..... 81/57.39

[58] Field of Search ..... 81/57.39; 74/833, 522; 192/46

[56] References Cited

U.S. PATENT DOCUMENTS

| | | | |
|---|---|---|---|
| 1,812,816 | 6/1931 | Weaver | 81/57.39 |
| 2,054,747 | 9/1936 | Green et al. | 192/46 |
| 2,703,062 | 3/1955 | Miller et al. . | |
| 3,745,858 | 7/1973 | Biach | 81/57.39 |
| 3,802,239 | 4/1974 | Karmann et al. . | |

FOREIGN PATENT DOCUMENTS

| | | |
|---|---|---|
| 1293739 | 4/1962 | France . |
| 558378 | 5/1943 | United Kingdom . |
| 795166 | 5/1958 | United Kingdom . |

*Primary Examiner*—James L. Jones, Jr.
*Attorney, Agent, or Firm*—Georges A. Maxwell

[57] ABSTRACT

In a pneumatically driven power torque wrench comprising a frame stopped from movement relative to a related structure, a hydraulic cylinder and ram unit carried by the frame, a work output shaft rotatable relative to the frame and coupled with work to be turned in axial alignment therewith, a lever arm with one end freely rotatably engaged about the shaft and its other end drivingly coupled with the cylinder and ram unit; and ratchet means between the shaft and lever arm. The ratchet means comprises a ratchet wheel about the shaft and a plurality of circumferentially spaced spring-loaded pawls pivotally carried by the lever arm and engaging the wheel. The shape and the circumferential spacing of the teeth on the wheel and the pawls are such that when rotary driving engagement is established between the shaft and the lever arm, the central rotative axes of the work, shaft and said one end of the crank are concentric, independent of any bearing support between the shaft and the frame.

7 Claims, 11 Drawing Figures

60°
30°
30°
4
45
46
35
33
43
48
49
U
40
47
C
44
S
42
12
41
11
10
25
14
F
W
A
53
52

U
40
45
47
C
4
43
S
55
11
42
52
12
14
F
A
50

55
3
3

52
S
F
A
11
14
12
51
10
C
50
11
26
42
27

54
55
55
56
56

HYDRAULIC WRENCH

This is a continuation-in-part of our application Ser. No. 337,535, filed Jan. 7, 1982, now abandoned, and entitled "HYDRAULIC WRENCH".

This invention has to do with a torque wrench and is particularly concerned with an improved hydraulic wrench.

BACKGROUND OF THE INVENTION

Throughout the mechanical art there are numerous instances where screw fasteners and the like are employed to secure parts together and where forces exerted onto and through the fasteners and their related parts must be limited or set at some predetermined values which require that predetermined torsional forces be applied onto and through the fasteners when they are tightened or made up. To the above end, the prior art has developed and provides various kinds and casses of wrenches which limit or indicate the torsional forces delivered onto and through the fasteners with which they are related to effect tightening and setting of the fasteners.

One special type or class of torque wrench provided by the prior art comprises a hydraulically operated mechanism which includes a drive shaft carrying a work or fastener engaging head, a crank or lever arm drivingly coupled with the shaft by means of a ratchet mechanism, a double acting hydraulic cylinder and ram unit connected with the crank and operated (reciprocally) to drive the shaft and tighten the fastener engaged by said head. In addition to the above, such wrenches include elongate frames or bodies which carry the shafts and cylinder and ram units and which serve as reaction parts or as part of reaction mechanisms which engage and/or stop with or against a stationary reactive structure relative to which the shafts turn and which counter the forces delivered to the fasteners.

The above noted type or class of torque wrench is most commonly used in situations where large fasteners must be turned or worked upon and where very high torsional forces are to be applied into and through the fasteners. Such wrenches are particularly useful in those situations where working clearances at and about the fasteners to be worked upon is so limited that those other types and classes of wrenches which include elongate manually engageable lever arms cannot be effectively or conveniently used.

In hydraulic torque wrenches of the class here concerned with, the amount of torque delivered to related fasteners is supposed to be directly proportional to the pressure on the hydraulic fluid delivered into the cylinder and ram units. Accordingly, by adjusting the pressure of the fluid delivered to those units, as by means of a motor driven hydraulic pump and related pressure regulating means, the torsional forces delivered to the fasteners can be adjusted, as desired or as circumstances require.

In all of the prior torque wrenches of which we are aware, the drive shafts are rotatably supported or carried by pairs of spaced bearings set in frame structures which carry the cylinder and ram units and serve as reaction parts. The ratchet mechanisms in those wrenches, between the drive shafts and cranks thereof, include ratchet wheels fixed to the drive shafts, between the noted bearings. The ratchet mechanisms include one or more spring loaded pawls pivotally carried by the cranks and engageable with the ratchet wheels. The cranks are simple elongate lever arms with outer ends with which the cylinder and ram units are connected and which have inner ends arranged between the noted bearings. The inner ends have large apertures through which the shafts extend and in which the ratchet wheels are freely arranged. The apertures in the cranks are provided with recesses in which the spring loaded pawls are arranged. The teeth of the ratchet wheels and the pawls are disposed so that when the cranks are turned in one "drive" direction, the pawls engage the teeth on the wheels and establish driving engagement between the cranks and wheels and are such that when the cranks are turned in the other "return" direction, the pawls disengage the ratchet teeth and allow for substantial free relative rotation between the crank and the wheel.

While the above ratchet mechanism is a simple straight-forward and apparently effective mechanism, it has proven to be wanting and the frequent source of malfunctioning of such wrenches. In the ratchet mechanism of most prior art wrenches, a single pawl is provided. In those prior art structures where the ratchet mechanisms include a plurality of pawls, the pawls are not arranged about the ratchet wheels in balanced relationship. As a result, when the cranks are turned in said driven direction and the pawls establish driving engagement with their related ratchet wheels, the pawls urge the cranks radially to one side and out of axial alignment with the ratchet wheels and/or urge the ratchet wheels and drive shafts out of axial alignment with the crank. The above noted displacement of parts often upsets the geometry of the wrenches to an extent that when high forces are transmitted in and through the wrenches, excessive and unacceptable error exists between the input and output thereof. Further, where high forces are encountered, and the wheels shift out of axial alignment with the cranks, the teeth of the wheels engage the surfaces of the apertures in the cranks with resulting abrading away of and deformation of the teeth and of the crank. Such abrading and deforming of parts inevitably results in serious adverse effects.

In addition to the above, misalignment of the wheel and shaft assemblies relative to the cranks results in altering the geometry of the wrenches so that the shafts are urged laterally from central alignment within the bearings and in such a manner that increased friction losses are encountered. Such friction losses are frequently substantial and such that the work output of such wrenches is not uniform, predictable or dependable. Evidence of the foregoing is the requirement and provision of anti-friction bearings for the shaft in certain of those hydraulic torque wrenches provided by the prior art and/or by the apparent rapid degradation of the shaft bearings in such wrenches.

In theory, if the geometry of such wrenches is stable, the point of reaction for the wrenches is fixed and the related axes of the crank, ratchet wheel and output shafts remain concentric, the bearings for the shaft are substantially unloaded during driving motion of the wrenches and the provision of anti-friction bearings or the like, for the shafts, is not required.

OBJECTS AND FEATURES OF THE INVENTION

It is an object and feature of our invention to provide an improved hydraulic torque wrench of the class referred to above which includes a novel ratchet mechanism in combination with the crank and the ratchet wheel and shaft assembly of the wrench whereby the ratchet mechanism maintains the ratchet wheel and shaft assembly concentric with the rotative axis of the crank.

An object and feature of our invention is to provide an improved wrench structure of the character referred to above wherein the ratchet mechanism includes two or more pawls spaced circumferentially about and engaging the ratchet wheel to normally support the ratchet wheel on its predetermined designed axis and concentric with its related axis of the crank when the pawls establish driving engagement with the ratchet wheels.

Still another object and feature of our invention is to provide a wrench of the character referred to above wherein the pawls are pivotally supported and the teeth of the ratchet wheel and the pawls are formed to establish seated engagement with each other, upon applied pressure therebetween, whereby the pawls urge and move the ratchet wheel into predetermined position where said pawls support the ratchet wheel with its axis concentric with its related axis of the crank.

Yet another object and feature of our invention is to provide a wrench with a ratchet mechanism of the character referred to above wherein the ratchet pawls are loosely held in effective working relationship within the construction and against displacement by movement of the ratchet wheel relative thereto by simple novel retaining means.

The foregoing and other objects and features of our invention will be fully understood from the following detailed description of our invention, throughout which description reference is made to the accompanying drawings.

DETAILED DESCRIPTION OF THE INVENTION

Figure 1:
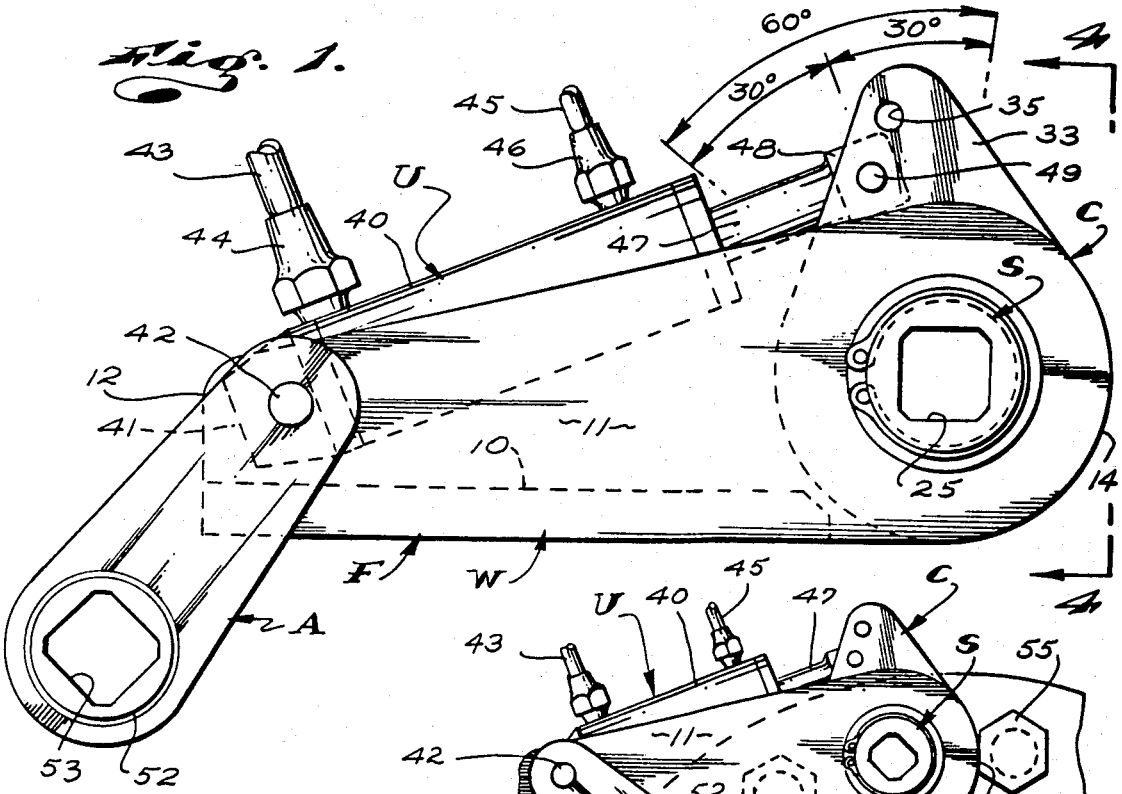
FIG. 1 is a side elevational view of a wrench including our invention.

Referring to the drawings, the hydraulic torque wrench W includes an elongate upwardly opening U-shaped body or frame F comprising a flat horizontal bottom wall 10 and a pair of flat, longitudinally extending, laterally spaced vertical side walls 11. The bottom and side walls terminate at a rear end 12 of the frame. The side walls have radiused front ends 14. The front end of the bottom wall 10 terminates a short distance rearward from the front ends of the side walls.

The front end portion of the side walls 11 are provided with a pair of large diameter axially aligned through openings 15. The rear end portion of the side walls are provided with a pair of small axially aligned openings 16 which will hereinafter be called the pivot openings.

In practice, the frame F can be a unitary machined part or can be a fabricated assembly comprising its several noted walls suitably screw-fastened together. In the case illustrated, to facilitate assembly of the construction, the several walls 10 and 11 are separate parts releasably secured together by screw fasteners.

The wrench W next includes an elongate, laterally extending drive shaft S extending between and through the front end portions of the side walls 11. The shafts have opposite cylindrical end portions 20 which extend substantially freely through the openings 15 in said side walls.

The shaft S is retained in the frame, against axial displacement, by snap rings 21 engaged in snap ring grooves 22 in its end portions. The snap rings can slidably engage the exterior surfaces of the side walls 11 about the openings 15 therein.

Figure 3:
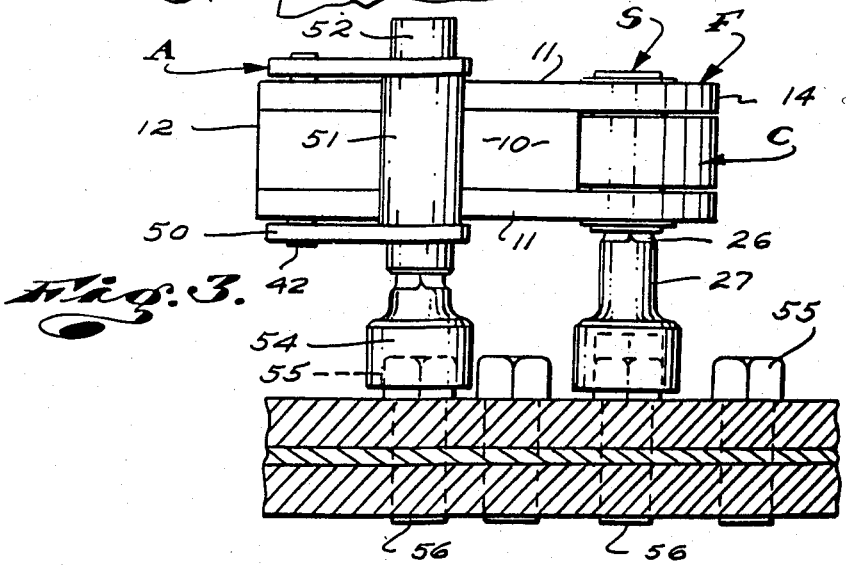
FIG. 3 is a view taken as indicated by line 3—3 on FIG. 2.
Figure 4:
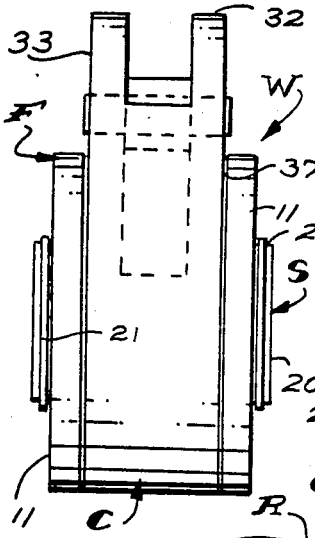
FIG. 4 is a view taken as indicated by line 4—4 on FIG. 1.
Figure 5:
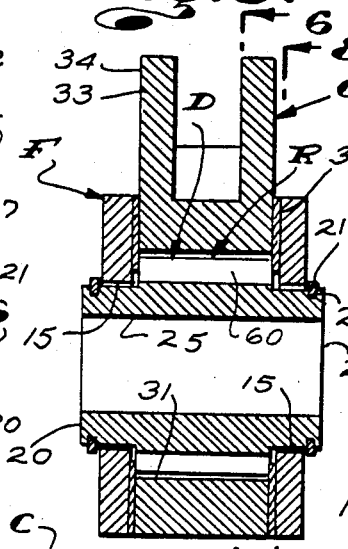
FIG. 5 is a sectional view of the structure shown on FIG. 4.

The shaft S has a central longitudinal polygonal opening 25 which opens at the opposide ends of the shaft and cooperatively receives the polygonal coupling posts 26 of work-engaging heads, such as bolt head-engaging sockets 27, as clearly shown in FIG. 3 of the drawings.

In practice, the polygonal opening 25 can be replaced by polygonal drive pins or can be replaced by any other desired tool or work-engaging coupling part or device, without departing from the broader spirit of our invention.

Finally, the shaft S includes a central enlarged ratchet wheel D arranged and extending axially of the shaft and laterally between the forward end portions of the side walls 11 of the frame F. The ratchet wheel D is a part of a ratchet mechanism R. While the wheel D is shown formed integrally on or with the shaft S, it will be apparent that in practice, it might be a separate part slidably engaged on and keyed to the shaft, without departing from the spirit of our invention.

Details of the ratchet mechanism R of which the wheel D is a part will be considered in full detail in the following.

The wrench next includes a crank C with an enlarged lower inner end 30 arranged between the forward end portions of the side walls 11 of the frame and having a laterally extending through opening or aperture 31 through which the shaft S extends and in which the ratchet wheel D is freely rotatably positioned. The crank C has a small, upper outer end 32 formed to establish a clevis 33 comprising a pair of laterally spaced parallel plates 34 with one or more pairs of axially aligned drive pin openings 35.

The opening or aperture in the lower inner end portion of the crank is provided with two or more radially inwardly opening, elongate, axially opening slot-like recesses 36 to receive and hold pawls P of the ratchet mechanism R, as will hereinafter be described.

In the case illustrated, the crank C is a unitary machined part, but could be fabricated of two or more parts if desired or if circumstances require.

In the case illustrated, the lower inner end portion of the crank has annular retaining and/or bushing plates 37 screw-fastened to its opposite sides to slidably engage the inside opposing surfaces of the side walls 11 of the frame F and which overlie and close the opposite ends of the pawl receiving recesses 36.

The wrench W next includes an elongate, double acting hydraulic cylinder and ram unit U of suitable and desired design, construction and capacity. In the case illustrated, the unit U includes an elongate cylinder 40 with front and rear ends. The cylinder 40 is arranged between the rear end portions of the side wall of the frame F. The rear end of the cylinder 40 has an apertured tongue 41 pivotally coupled with the frame by a pin 42 engaged through said tongue and extending laterally therefrom and through the pivot openings 16 in the side walls 11.

Figure 2:
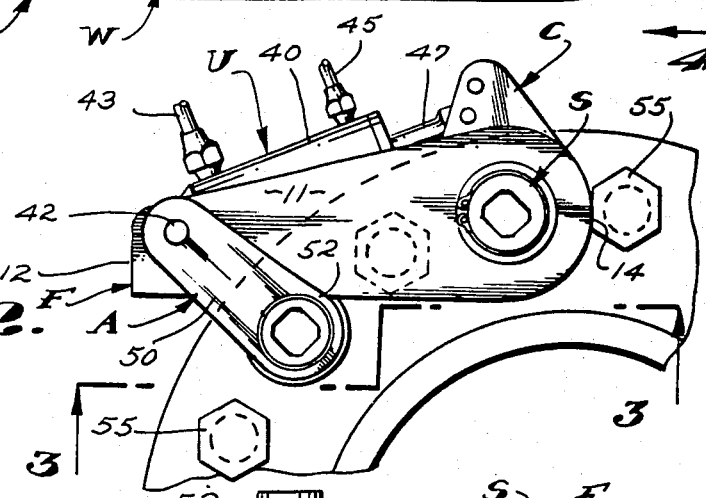
FIG. 2 is an elevational view showing thr wrench related to work.

The rear end portion of the cylinder 40 is connected with a high pressure fluid conductor 43 by means of a fitting 44 and the forward end portion thereof is connected with a low pressure fluid conductor 45 by means of a fitting 46, in accordance with common practice and as shown in FIGS. 1 and 2 of the drawings.

The unit U next includes an elongate cylindrical ram 47 projecting axially forward from the cylinder 40. The ram 47 has an apertured coupling head 48 at its forward end. The head 48 is engaged between the clevis plates 34 at the upper outer end of the crank C and is drivingly connected with the crank by a pin 49 engaged through the head and through a related pair of the registering pin openings 35 in the crank.

The structure thus far described establishes a complete and operable hydraulic torque wrench structure which is suitable for use and operation in a great number of common and special circumstances.

In addition to the foregoing, the wrench W is shown provided with novel anchor means A to facilitate anchoring the rear end of the frame in fixed relationship with parts of related work. The means A includes a pair of elongate laterally spaced shackle plates 50 with forward apertured ends pivotally engaged with the ends of the pin 42 at the rear end of the frame 11. The anchor means A next includes a tube 51 fixed to and extending between the other or rear ends of the shackle plates 50 and an elongate tool coupling rod 52 rotatably and slidably engaged in and through the tube 51. The rod 52 is provided with a longitudinal polygonal openings 53 to effect coupling the rod with the polygonal part of a work-engaging head or socket 54, as shown in FIG. 3 of the drawings.

With the above noted anchor means A, the wrench W can be effectively anchored to one and drivingly coupled with another of two spaced apart heads 55 of fasteners 56 in a related structure to be worked upon (as shown in FIGS. 2 and 3 of the drawings). It will be apparent that the means A is such that by suitably pivoting the shackle structure relative to the frame F, adjustments can be made to compensate for differences in the spacing between the fastenees with and between which the torque wrench structure is engaged.

Referring again to the ratchet means R, the ratchet wheel D has a plurality of circumferentially spaced radially outwardly projecting elongate, axially extending teeth with substantially flat, radially outwardly disposed ridges 61 occurring in limited spaced relationship with the surface of the aperture 31 in the crank C. The teeth 60 have circumferentially rearwardly and radially outwardly disposed alongate inclined drive flanks 62 extending longitudinally of and parallel with the axes of the shaft S and wheel D and flat, circumferentially forwardly and radially outwardly disposed elongate inclined orienting flanks 63 extending longitudinally of and parallel with the axes of the shaft S and wheel D.

The flanks 62 and 63 of adjacent teeth 60 are on right angularly related planes and cooperate to establish a plurality of circumferentially spaced substantially radially outwardly opening, elongate, trough-like pawl receiving seats 64 extending longitudinally of the shaft S and wheel D.

The axial extent of the wheel D and corresponding longitudinal extent of the teeth 60 and seats 64 is at least equal to and is preferably substantially greater than the major radial extent of the wheel D. In the drawings, the major radial extent of the wheel D is equal to approximately three-quarters the longitudinal extent of the teeth and seats.

Further, and as clearly shown in the drawings, the lateral extent or width of the orienting flanks 63 (that dimension taken transverse the longitudinal axis of those flanks) is at least equal to and is preferably greater than the lateral extent or width of the drive flanks 62 (that dimension taken transverse the longitudinal axis of those flanks). In the drawings, the width of the flanks 62 is equal to approximately three-quarters the width of the orienting flanks 63.

The qualifying terms "forwardly" and "rearwardly" refer to the direction in which the crank C is turned relative to the axes of the shaft S and wheel D when the ratchet mechanism establishes driving engagement and overriding engagement between the crank C and the shaft S.

The pawls P are elongate, plate-like bars substantially equal in longitudinal extent with the teeth 60 and seats 64 of the wheel D and are positioned relative to the wheel D and are parallel with the rotative axis of the shaft S and wheel D and longitudinal of the teeth 60 and seats 64 of said wheel. The pawls P have straight, flat, longitudinally extending, normally circumferentially forwardly and radially inwardly disposed forward drive surfaces 65 which oppose and engage related drive flanks 62 of the teeth 60 when the ratchet mechanism R is in driving engagement. The drive surfaces 65 are preferably substantially equal in width (that dimension taken transverse their longitudinal axes) than the above noted width of the drive flanks 62, whereby maximum potential bearing contact between the drive flanks and surfaces 62 and 65 is assured.

The pawls P next include and are characterized by straight, flat, longitudinally extending, normally circumferentially rearwardly and outwardly inclined and radially inwardly disposed inner orienting surfaces 66 on planes at right angle to the planes of the drive surfaces 65 and which oppose and engage related orienting flanks 63 of related teeth 60 when the ratchet mechanism is in driving engagement. The orienting surfaces 66 are at least equal and, as shown, are preferably substantially greater in lateral extent (the dimension taken transverse their longitudinal axes) than the above noted width of the orienting flanks 63 whereby maximum potential bearing contact between the orienting flanks and surfaces 63 and 66 is assured.

The pawls P next include outer surfaces 67 (opposite their orienting surfaces 66) and straight, longitudinally extending circumferentially rearwardly and radially outwardly disposed, radiused, rear bearing edges 68.

In carrying out our invention, the number of teeth 60 and resulting number of seats 64 and the number and placement of pawls P is such that the circumferential spacing of adjacent pawls is equal at those points where the forces between each pawl and its related drive flank 62 are resolved.

Figure 6:
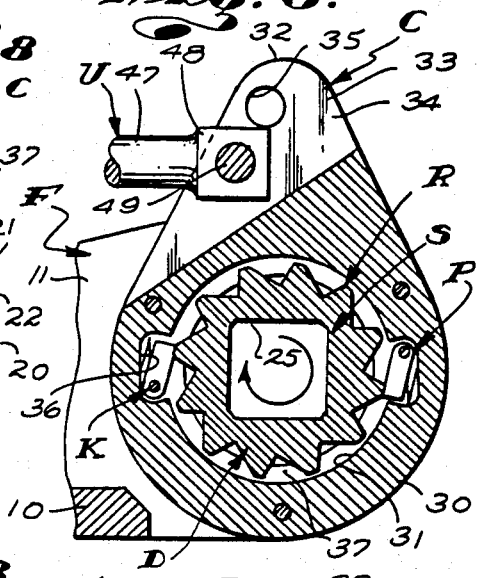
FIG. 6 is a view taken as indicated by line 6—6 on FIG. 5.
Figure 7:
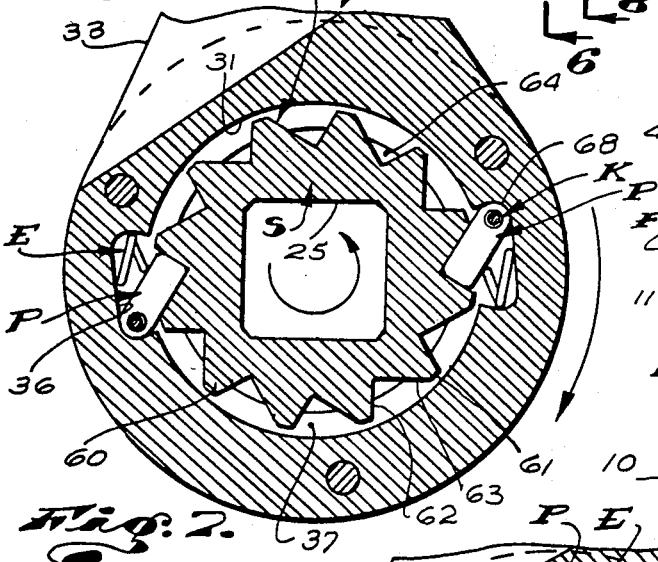
FIG. 7 is an enlarged view of the structure shown on FIG. 6.
Figure 8:
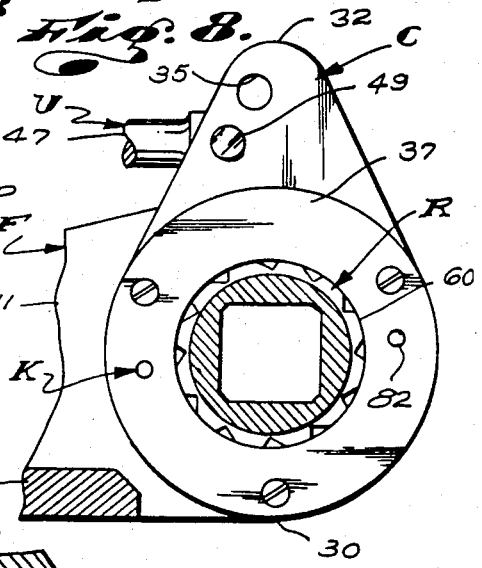
FIG. 8 is a view taken as indicated by line 8—8 on FIG. 5.
Figure 9:
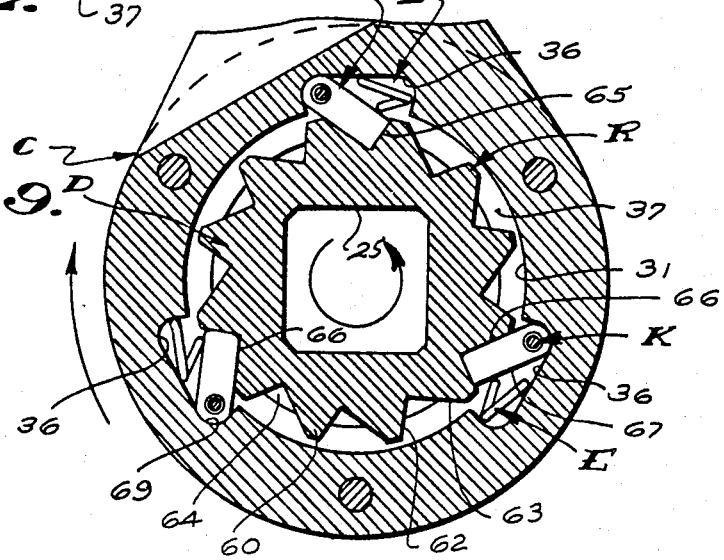
FIG. 9 is a view similar to FIG. 7 showing another form of our invention.

In practice, there must be at least two and preferably three or more pawls in order to attain the geometric balance and self-aligning characteristics our invention provides. In the drawings, the wheel D is shown as having twelve teeth 60 and twelve seats 64. In FIGS. 6, 7 and 8 of the drawings, we have shown the wrench structure provided with but two pawls spaced 180° apart. In FIG. 9 of the drawings, we show the wrench including three pawls, each spaced 120° from the other. In both of these embodiments of our invention, the number and placement of pawls is geometrically balanced and is such that the pawls work to hold and support the shaft S on its designed axis, within the construction, when the pawls are fully seated with their related teeth of the ratchet wheel.

When the ratchet mechanism R is in driving engagement, the outer rear portions of the pawls normally project circumferentially rearwardly and radially outward from the seats 64 and the outer perimeter of the ratchet wheel D and into related elongate recesses 36 formed in the crank C, with their radiused outer bearing edges or surfaces 38 in pivoted seated bearing engagement in elongate longitudinally extending circumferentially forwardly and radially inwardly disposed radiused pivot seats 69 formed in the rear portions of the recesses, as clearly shown in the drawings.

The recesses 36 are coextensive and are parallel with the axis of the opening 31 in the crank C and with the pawls P, teeth 60 and seats 64.

The circumferential extent or width of the recesses 36 (the dimension taken transverse their longitudinal axes) is substantially greater than the width (front to rear dimension) of the pawls P. The recesses 36 are preferably slightly greater in radial extent or depth than the thickness (surface 66 to surface 67 dimension) of the pawls P, whereby the pawls, when pivoted radially outward about the turning axes of the bearing edges and bearing seats, occur wholly within their related recesses, spacially clear of and out of interfering relationship with the ratchet wheel D.

In practice and as clearly shown in the drawings, the longitudinal extent of the pawls P is greater than twice their maximum width (the distances between the surfaces 65 and 68), whereby they establish stable, positive aligned engagement with and between the flanks 62 and seats 69 and are not subject to being pivoted out of alignment upon the directing of non-aligned forces therethrough.

The ratchet means next includes spring means E to normally yieldingly urge the forward end portions of the pawls radially inwardly about the turning axes of the bearing edges and seats and into engagement in and with related seats 64 in the wheel D. The spring means E can vary widely in form and is shown as including simple wire loop-springs with pairs of adjacent loops biased to occur on angularly related planes and arranged within the recesses 36 with their loops in flat pressure bearing engagement on and with related surfaces 67 of the pawls P and the flat bottoms of the recesses. The loops of the springs are preferably elongated to extend throughout the major longitudinal extent of their related recesses and pawls.

Figure 10:
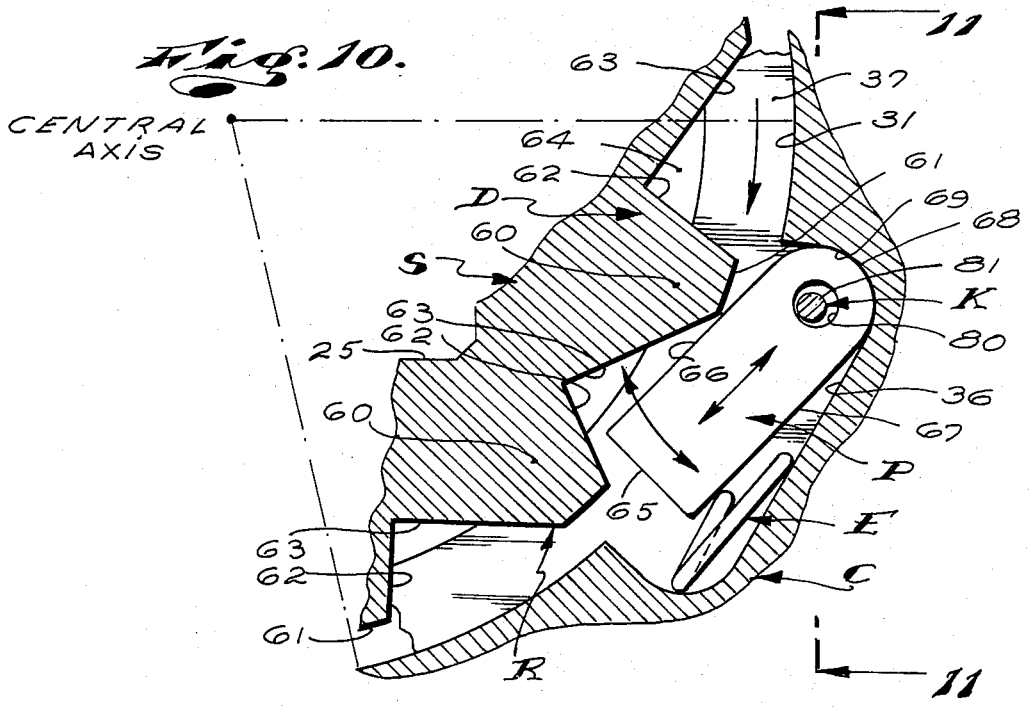
FIG. 10 is an enlarged detailed view of a portion of the construction.
Figure 11:
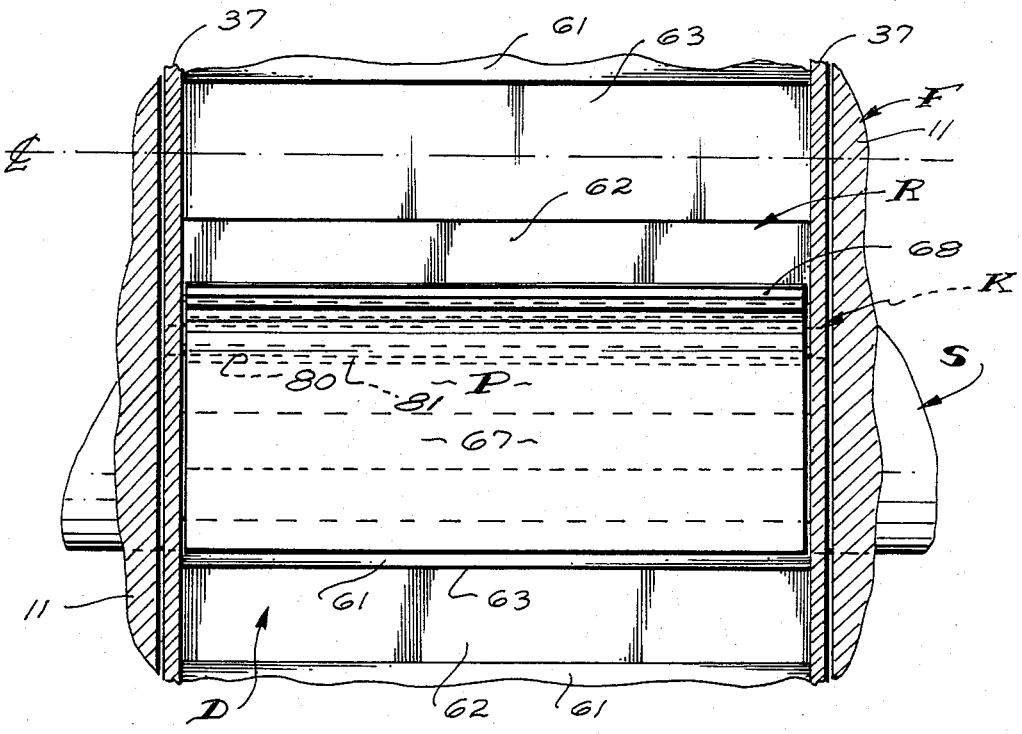
FIG. 11 is taken on line 11—11 on FIG. 10.

Finally, the ratchet mechanism R includes novel pawl retaining means K. The retaining means K, which is best shown in FIG. 10 of the drawings, includes large diameter, longitudinally outwardly openings 80 in the opposite ends of the outer rear portions of the pawls which occur in the rear portions of the recesses 36; and small diameter, longitudinally extending retaining pins 81 carried by the crank and extending freely into the openings. The pins 81 occur within the openings 80 with sufficient clearance so as not to prevent or interfere with physical movement of the pawls relative to the recesses 36 and seats 64, yet suitably limiting radial inward and circumferential forward movement or displacement of the pawls in the recesses when the crank C is pivoted counterclockwise or rearward relative to the shaft S and wheel D.

The means K is such that the outer pivotal ends of the pawls are stopped and prevented from moving radially inwardly into interfering engagement with the wheel D and is such that the pawls are prevented from moving circumferentially forwardly or clockwise relative to the crank in such a manner that their inner forward teeth-engaging portions are out of proper register with the teeth 60 or in such a manner that said forward teeth engaging portions might establish interfering engagement with the forward or leading edges of the recesses 36.

In the form of our invention shown, the pins 81 have end portions engaged in openings 82 in those portions of the shim plates 37 which overlie their related ends of the recesses 36.

It is important to note that the means K affords a large degree of play and free movement for the pawls and is not a pivotal mounting means for the pawls which would inhibit their free working within the construction.

With the ratchet mechanism illustrated in the drawings and described above, it will be apparent that upon turning of the crank C rearwardly in a counterclockwise direction relative to the shaft S, the elongate pawls are cammed radially outward, out of seated engagement in the elongate seats 64 defined by the teeth 60, as shown in FIGS. 6 and 10 of the drawings. When the crank is moved forwardly in a clockwise direction relative to the shaft, the spring means urge the pawls radially inward into registering seats 64 to establish stopped driving engagement with the flanks 62 and 63 of related teeth of the wheel D. As a result of the circumferential balanced relationship of the elongate pawls and the mating relationship of the pawls in and with the elongate seats 64 defined by related flanks 62 and 63 of adjacent teeth 60; when the spring means urge the pawls inwardly, the pawls move into full seated and supported engagement with said flanks of their related seats 64 to centralize and to stably support and maintain the wheel D and shaft S centralized in the construction, i.e., concentric with the axis of the opening 31 in the forward end of the crank C.

When the pawls are seated or set in the above manner, the shaft cannot be moved out of alignment by torsional forces exerted onto and through the construction and all forces transmitted between the shaft S and crank C are equally divided between and conducted directly through the pawls. Further, since the longitudinal extent of seats 64 and pawls P is equal to or greater than the major radial extent of the ratchet wheel D (and the shaft S), forces transmitted between the shaft S and crank C are distributed uniformly longitudinally of the wheel D and shaft S throughout a distance equal to or greater than the radial extent thereof, whereby the ratchet means urges and effectively holds the wheel D and shaft S centered. Since the longitudinal extent of the bearing support afforded by the ratchet means R between the crank C and shaft S is equal to or greater than the radial extent of the wheel D (and the shaft S), the mechanical advantage or leverage afforded by the ratchet means to resist lateral or radial pivotal displacement and misalignment of the shaft S relative to the crank C is at least equal to or greater than the mechanical advantage or leverage afforded by the radial extent of the wheel D with respect to those forces which might tend to pivot or turn the shaft out of alignment with the turning axis of the crank. Accordingly, the ratchet means effectively and stably holds the shaft S concentric with the turning axis of the crank and effectively counters those forces likely to be encountered and which would tend to turn or pivot the shaft out of alignment relative to the crank.

In accordance with the above, our new wrench structure is such that when in use and working forces are exerted through it, the elongate pawls of the ratchet means stably center and set the ratchet wheel and shaft concentric with the opening 31 in the crank C. The geometry of our new wrench is such that it cannot be upset as a result of misalignment of parts and is such that wear and/or damage to its parts, resulting from misalignment thereof, is therefore eliminated. It is significant to note that with our new wrench structure, the shaft and/or wheel D need not be and are not supported within the opening 31 and relative to the crank C by additional axially spaced support bearing means which characterize all prior art wrenches of the class here concerned with.

Having described only typical preferred forms and applications of our invention, we do not wish to be limited to the specific details herein set forth but wish to reserve to outselves any modifications and/or variations that might appear to those skilled in the art and which fall within the scope of the following claims:

Having described our invention, we claim:

1. A hydraulic wrench comprising an elongate horizontal frame with front and rear ends and laterally spaced side walls, a pair of axially aligned openings in the front end portion of the side walls, an elongate drive shaft extending freely between and through said openings, means at the shaft to establish driving engagement with work-engaging tools, an elongate crank with a lower end positioned between the side walls and having an elongate opening concentric with and through which the shaft freely extends, said crank has an upper end spaced radially from the axis of the shaft, an elongated double acting cylinder and ram unit with front and rear ends, connecting means pivotally connecting the rear end of the unit to the rear end of the frame and coupling means pivotally coupling the front end of the unit to the upper end of the crank, said unit operates to pivot the crank circumferentially forwardly and circumferentially rearwardly about the axis of the shaft; ratchet means between the shaft and the crank releasably establishing driving engagement therebetween when the crank is pivoted forwarded and establishing overriding engagement therebetween when the crank is pivoted rearward, said ratchet means includes an elogate ratchet wheel on and projecting radially outward from the shaft, the wheel is greater in axial extent than in radial extent and extends longitudinally of the shaft between the ends thereof, said wheel has a plurality of elongate longitudinally extending circumferentially spaced radially outwardly projecting teeth substantially coextensive with the longitudinal extent of the wheel and the opening in the crank, said teeth have elongate longitudinally extending circumferentially rearwardly and radially outwardly disposed flat rear drive flanks and elongate longitudinally extending circumferentially forwardly and radially outwardly disposed flat orienting flanks, the adjacent drive and orienting flanks of adjacent teeth are on right angularly related planes; a plurality of elongate longitudinally extending radially inwardly opening recesses in the crank in uniform circumferential spaced relationship about and coextensive with the opening in the crank, the recesses have circumferentially forwardly and radially inwardly disposed rear bearing surfaces coextensive with and extending longitudinally thereof; a plurality of elongate pawls substantially equal in longitudinal extent with and extending parallel with and longitudinally of the teeth and the recesses, the pawls have longitudinally extending circumferentially rearwardly and radially outwardly disposed rear bearing edges pivotally engaged in the rear bearing seats of related recesses, longitudinally extending circumferentially forward and radially inward disposed flat drive surfaces normally opposing and in flat uniform bearing engagement with the drive flanks of related teeth, longitudinally extending circumferentially rearwardly and radially inwardly disposed flat inner orienting surfaces normally opposing and in flat uniform bearing engagement with the orienting flanks of related teeth and outer surfaces disposed substantially radially outwardly toward their related recesses, the width of the pawls between their bearing edges and drive surfaces is less than one-half their longitudinal extent, said pawls are pivotally movable about the turning axes of their bearing edges and radially outward relative to their related recesses and from engagement with the ratchet wheel and into said recesses; and spring means in the recesses engaging the pawls and normally yieldingly urging the pawls radially inwardly into engagement with the wheel.

2. The hydraulic wrench set forth in claim 1 wherein the bearing seats in the recesses and the bearing edges of the pawls have complimentary opposing radiused surfaces normally establishing uniform bearing engagement with each other.

3. The hydraulic wrench set forth in claim 1 which further includes means to prevent longitudinal displacement of the pawls from within the recesses and relative to the wheel and including annular retaining plates at opposite sides of the crank and having radial inner portions overlying related open ends of the recesses.

4. The hydraulic wrench set forth in claim 1 which further includes retaining means to prevent circumferential and radial displacement of the pawls relative to the recesses and the wheel and including large diameter pin receiving openings opening longitudinally outward at the opposite ends of the pawls and small diameter pins normally projecting longitudinally freely into the pin receiving openings.

5. The hydraulic wrench set forth in claim 1 which further includes means to prevent longitudinal displacement of the pawls from within the recesses and relative to the wheel and including annular retaining plates at opposite sides of the crank and having radial inner portions overlying related open ends of the recesses, and retaining means to prevent circumferential and radial displacement of the pawls relative to the recesses and the wheel and including large diameter pin receiving openings opening longitudinally outward at the opposite end of the pawls and small diameter pins carried by the crank and normally projecting longitudinally freely into said pin receiving openings.

6. The hydraulic wrench set forth in claim 1 wherein the bearing seats in the recesses and the bearing edges of the pawls have complimentary opposing radiused surfaces normally establishing uniform bearing engagement with each other, said wrench further includes means to prevent longitudinal displacement of the pawls from within the recesses and relative to the wheel and including annular retaining plates at the opposite sides of the crank and having radial inner portions overlying related open ends of the recesses.

7. The hydraulic wrench set forth in claim 1 wherein the bearing seats in the recesses and the bearing edges of the pawls have complimentary opposing radiused surfaces normally establishing uniform bearing engagement with each other, said wrench further includes means to prevent longitudinal displacement of the pawls from within the recesses and relative to the wheel and including annular retaining plates at the opposite sides of the crank and having radial inner portions overlying related open ends of the recesses, and retaining means to prevent circumferential and radial displacement of the pawls relative to the recesses and the wheel and including large diameter pin receiving openings opening longitudinally outward at the opposite ends of the pawls and small diameter pins carried by the annular retaining plates and normally projecting longitudinally freely into the pin receiving openings.

* * * * *